US005695922A

United States Patent [19]

Reed et al.

[11] Patent Number: 5,695,922

[45] Date of Patent: Dec. 9, 1997

[54] HIGH CHLORIDE 100 TABULAR GRAIN EMULSIONS CONTAINING A HIGH IODIDE INTERNAL EXPITAXIAL PHASE

[75] Inventors: Kenneth Joseph Reed, Rochester; Jeffrey Christen Hansen, Fairport, both of N.Y.

[73] Assignee: Eastman Kodak Company, Rochester, N.Y.

[21] Appl. No.: 697,811

[22] Filed: Aug. 30, 1996

[51] Int. Cl.[6] ..... G03C 1/035

[52] U.S. Cl. ..... 430/567

[58] Field of Search ..... 430/567

[56] References Cited

U.S. PATENT DOCUMENTS

| | | | |
|---|---|---|---|
| 4,094,684 | 6/1978 | Maskasky . | |
| 4,142,900 | 3/1979 | Maskasky . | |
| 4,158,565 | 6/1979 | Maskasky . | |
| 4,425,425 | 1/1984 | Abbott | 430/502 |
| 4,425,426 | 1/1984 | Abbott | 430/502 |
| 4,433,048 | 2/1984 | Solberg et al. | 430/434 |
| 4,434,226 | 2/1984 | Wilgus et al. | 430/567 |
| 4,439,520 | 3/1984 | Kofron et al. | 430/434 |
| 4,459,353 | 7/1984 | Maskasky | 430/567 |
| 4,490,458 | 12/1984 | House | 430/503 |
| 4,806,461 | 2/1989 | Ikeda | 430/567 |
| 5,061,609 | 10/1991 | Piggin et al. | 430/569 |
| 5,061,616 | 10/1991 | Piggin et al. | 430/569 |
| 5,096,806 | 3/1992 | Nakamura | 430/567 |
| 5,314,798 | 5/1994 | Brust et al. | 430/567 |
| 5,418,124 | 5/1995 | Suga et al. | 430/567 |
| 5,604,086 | 2/1997 | Reed et al. | 430/567 |

*Primary Examiner*—Mark F. Huff
*Attorney, Agent, or Firm*—Carl O. Thomas

[57] ABSTRACT

A photographic emulsion comprised of high chloride radiation-sensitive tabular grains comprised of a tabular host portion containing greater than 50 mole percent chloride, based on silver, and having spaced parallel {100} major faces, a high chloride shell accounting for at least 4 percent of total silver surrounding the host portion and, interposed between the shell and the host portion an internal epitaxial phase containing greater than 90 mole percent iodide, based on silver, overlying from 15 to 90 percent of the major faces of the host portion.

10 Claims, 3 Drawing Sheets

FIG. 1
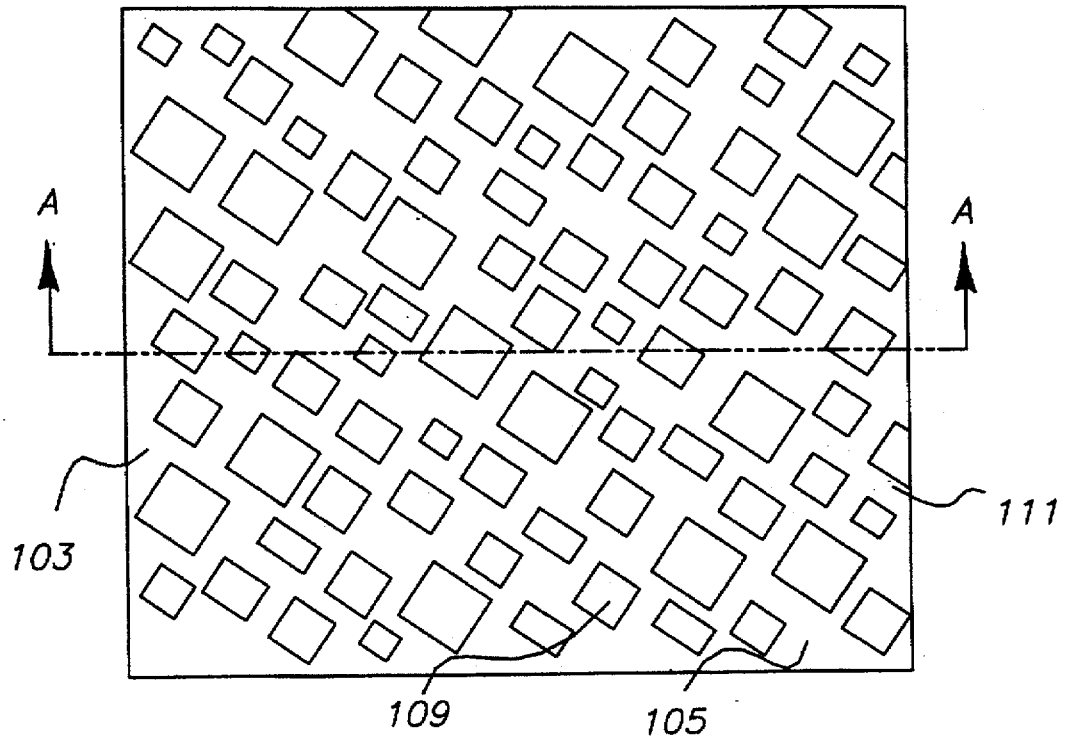
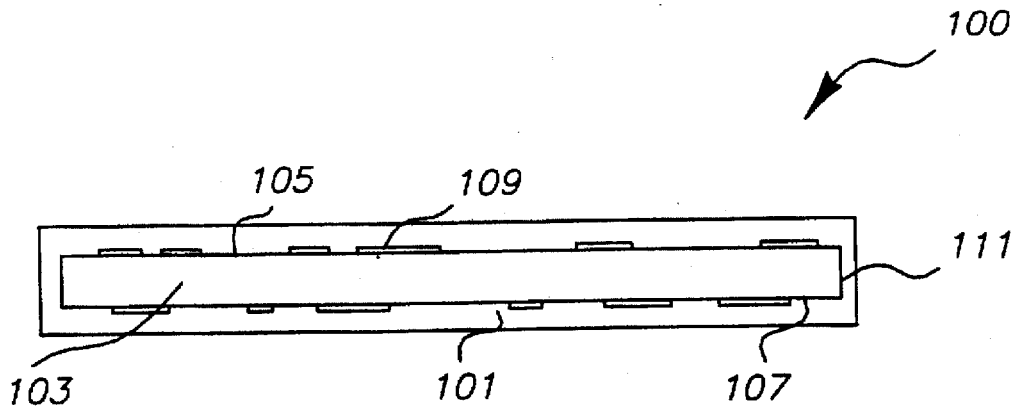
FIG. 2

1 μm

HIGH CHLORIDE 100 TABULAR GRAIN EMULSIONS CONTAINING A HIGH IODIDE INTERNAL EXPITAXIAL PHASE

FIELD OF THE INVENTION

The invention is directed to an improvement in photographic emulsions containing radiation-sensitive intermediate and higher aspect ratio tabular grains.

SUMMARY OF DEFINITIONS

In referring to silver halide emulsions, grains and grain regions containing two or more halides, the halides are named in order of ascending concentrations.

All references to the mole percentages of a particular halide in silver halide are based on total silver present in the grain region, grain or emulsion being discussed.

The term "high chloride" in referring to a grain region, grain or emulsion indicates greater than 50 mole percent chloride, based on silver.

The term "high iodide" in referring to a grain region, grain or emulsion indicates greater than 90 mole percent iodide, based on silver.

The symbol "μm" employed to denote micrometers.

The "equivalent circular diameter" (ECD) of a grain is diameter of a circle having an area equal to the projected area of the grain.

The "aspect ratio" of a silver halide grain is the ratio of its ECD divided by its thickness (t).

The "average aspect ratio" of a tabular grain emulsion is the quotient of the mean ECD of the tabular grains divided by their mean thickness (t).

The term "tabular grain" is defined as a grain having an aspect ratio of at least 2 and a ratio of adjacent edge lengths of 5:1 or less.

The term "tabular grain emulsion" is defined as an emulsion in which at least 50 percent of total grain projected area is accounted for by tabular grains.

The terms "thin" and "ultrathin" in referring to tabular grains and emulsions are employed to indicate tabular grains having thickness of <0.2 μm and <0.07 μm, respectively.

The term "dopant" refers to a material other than silver or halide ion contained in a silver halide crystal lattice structure.

All periods and groups of elements are assigned based on the periodic table adopted by the American Chemical Society and published in the *Chemical and Engineering News*, Feb. 4, 1985, p. 26, except that the term "Group VIII" is employed to designate groups 8, 9 and 10.

The term "meta-chalcazole" is employed to indicate the following ring structure:

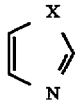

where X is one of the chalcogens: O, S or Se.

All spectral sensitizing dye oxidation and reduction voltages were measured in acetonitrile against a Ag/AgCl saturated KCl electrode, as described in detail by J. Lenhard *J. Imag. Sci.*, Vol. 30, #1, p. 27, 1986. Where oxidation or reduction potentials for spectral sensitizing dyes were estimated, the method employed was that described by S. Link "A Simple Calculation of Cyanine Dye Redox Potentials", Paper F15, International East-West Symposium II, October 30–Nov, 4 1988.

The term "inertial speed" refers to the speed of a silver halide emulsion determined from its characteristic curve (a plot of density vs. log E, where E represents exposure in lux-seconds) as the intersection of an extrapolation of minimum density to a point of intersection with a line tangent to the highest contrast portion of the characteristic curve. The inertial speed is the reciprocal of the exposure at the point of intersection noted above.

Speeds are reported as relative log speeds, where a speed difference of 1 represents a difference of 0.01 log E, where E is exposure in lux-seconds.

*Research Disclosure* is published by Kenneth Mason Publications, Ltd., Dudley House, 12 North St., Emsworth, Hampshire P010 7DQ, England.

BACKGROUND

Maskasky U.S. Pat. Nos. 4,094,684, 4,142,900 and U.S. Pat. No. 4,158,565 (collectively referred to as Maskasky I) disclose emulsions in which silver chloride is epitaxially deposited on nontabular silver iodide host grains. These patents are generally credited as the first suggestion that a silver iodide phase can be relied upon for photon capture while a developable latent image is formed in an epitaxially joined lower iodide portion of the grain. When a photon is captured within the iodide portion of the grain, a hole (photohole) and a conduction band electron (photoelectron) pair are created. The photoelectron migrates across the epitaxial junction to form a latent image in the lower iodide portion of the grain. On the other hand, the photohole remains trapped within the silver iodide phase. Thus, the risk of dissipation of absorbed photon energy by hole-electron recombination is minimized. House U.S. Pat. No. 4,490,458 and Maskasky U.S. Pat. No. 4,459,353 (collectively referred to as House and Maskasky) later placed silver chloride epitaxy on silver iodide tabular grains to combine the advantages of Maskasky I with those known to flow from a tabular grain configuration. Although the Maskasky I and the House and Maskasky emulsions offer superior performance compared to emulsions with grains consisting essentially of a high iodide silver halide phase, the performance of none of these emulsions has been sufficiently attractive to lead to commercial use in photography. The ratio of iodide to the remaining halide(s) is unattractively high while photographic speed and developability, though superior to grains consisting essentially of a high iodide silver halide phase, are slow.

Between the investigations of Maskasky I and those of House and Maskasky, a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds, and improved image sharpness in both mono- and multi-emulsion layer formats, can be realized by increasing the proportions of selected tabular grain populations in photographic emulsions. The tabular grains were initially selected to have a high (>8) average aspect ratio or at least an intermediate (5–8) average aspect ratio. The tabular grains were those having a face centered cubic rock salt crystal lattice structure (hereinafter referred to as an FCCRS crystal lattice structure), which a high iodide silver halide composition does not form, except under extreme conditions having no relevance to photography. Silver chloride, silver bromide and mixtures thereof in all ratios form an FCCRS crystal lattice structure. An FCCRS crystal lattice can accommodate minor amounts of iodide. The highest reported levels of photographic performance have been obtained with tabular grain emulsions containing silver iodobromide grains. Early disclosures of high and intermediate aspect ratio tabular grain emulsions with FCCRS crystal lattices are illustrated by Kofron et al U.S. Pat. No. 4,439,520, Wilgus et al U.S. Pat. No. 4,434,226 and Abbott et al U.S. Pat. Nos. 4,425,425 and 4,425,426.

High aspect ratio silver iodobromide tabular grains containing non-uniform iodide distributions are disclosed by Solberg et al U.S. Pat. No. 4,433,048, Ikeda et al U.S. Pat. No. 4,806,461, Nakamura et al U.S. Pat. No. 5,096,806, Piggin et al U.S. Pat. Nos. 5,061,609 and 5,061,616, and Suga et al U.S. Pat. No. 5,418,124. Generally (but not always) iodide has been incorporated in the grains in the FCCRS crystal lattices, and the highest iodide concentrations have been restricted to the edges or corners of the grains.

Brust et al U.S. Pat. No. 5,314,798 discloses the preparation of high chloride {100} tabular grain emulsions in which the tabular grains are comprised of a core and a surrounding band containing a higher level of iodide ions and containing up to 30 percent of the silver in the tabular grains. Brust et al speculates in column 9, lines 10 to 16, that a separate silver iodide phase may form, but no separate silver iodide phase in the completed emulsions has been observed. A separate iodide phase has been observed at the edges of the tabular grains, but not on their major faces, during precipitation, but this separate silver iodide phase disappeared as precipitation continued.

RELATED APPLICATIONS

Reed and Hansen U.S. Ser. No. 08/620,773, Mar. 22, 1996, now U.S. Pat. No. 5,604,086, commonly assigned, titled TABULAR GRAIN EMULSIONS CONTAINING A RESTRICTED HIGH IODIDE SURFACE PHASE, discloses a photographic emulsion comprised of a dispersing medium and radiation-sensitive silver halide grains with greater than 50 percent of total grain projected area being accounted for by grains containing a host portion of a face centered cubic rock salt crystal lattice structure and a first epitaxial phase containing greater than 90 mole percent iodide. The host portion is tabular, being bounded by an exterior having first and second parallel major faces joined by a peripheral edge. The first epitaxial phase accounts for less than 60 percent of total silver, and the first epitaxial phase is restricted to a portion of the exterior of the host portion that includes at least 15 percent of the major faces.

Reed and Hansen U.S. Ser. No. 08/706,081, filed concurrently herewith and commonly assigned, titled HIGH BROMIDE EMULSIONS CONTAINING A RESTRICTED HIGH IODIDE EPITAXIAL PHASE ON {111} MAJOR FACES OF TABULAR GRAINS BENEATH SURFACE SILVER HALIDE, discloses a photographic emulsion comprised of a dispersing medium and radiation-sensitive grains with greater than 50 percent of total grain projected area being accounted for by tabular grains comprised of (1) a tabular host portion containing greater than 50 mole percent bromide, based on silver, and having spaced parallel {111} major faces, (2) a first epitaxial phase containing greater than 90 mole percent iodide, based on silver, accounting for less than 60 percent of total silver and overlying from 15 to 90 percent of the major faces, and (3) surface silver halide of a face centered cubic crystal lattice structure overlying at least a portion of the first epitaxial phase.

PROBLEM TO BE SOLVED

Notwithstanding the many advances imparted to photographic imaging by FCCRS crystal lattice tabular grains, some shortcomings have been observed. FCCRS crystal lattice tabular grains work best when applied to minus blue (green and/or red) imaging, since they provide large surface areas in relation to grain volume for minus blue absorbing spectral sensitizing dyes. The silver halide itself lacks native minus blue sensitivity; hence reducing silver coating coverages while maintaining large surface areas for spectral sensitizing dye adsorption saves silver with little negative impact on imaging.

By comparison, the application of FCCRS crystal lattice tabular grains to forming blue exposure records has lagged. The reason is that traditionally the native blue sensitivity of has been heavily relied upon for latent image formation, even when blue spectral sensitizing dyes have been employed in combination with the grains. Attempts to realize the silver savings in blue recording emulsion layers that are routinely realized in minus blue recording emulsion layers by employing FCCRS crystal lattice tabular grains have resulted in speed penalties. The problem is exacerbated by the fact that, while daylight contains an equal amount of its total energy in the blue, green and red regions of the visible spectrum, blue photons contain more energy than either green and red photons; hence, daylight has available fewer blue photons than green or red photons for latent image formation. The problem cannot be corrected by simply increasing the levels of blue spectral sensitizing dye, since additional speed enhancement is not realized by dye additions beyond those that can be adsorbed to the grain surfaces. Kofron et al suggests increasing the maximum thickness of tabular grains from 0.3 μm to 0.5 μm to enhance their blue absorption. In the highest speed multicolor photographic elements it is common for the fastest minus blue recording emulsion layers to be formed using tabular grain emulsions while the fastest blue recording emulsion layer employs nontabular grains. Since the highest speed blue recording layer is typically the first emulsion layer to receive exposing radiation, there is a significant negative impact by the nontabular grains on the sharpness of the images in all of the remaining emulsion layers.

Another problem inherent in the conventional choices of FCCRS crystal lattice tabular grains is that the techniques disclosed by Maskasky I for photohole and photoelectron separation, with attendant reduction in their recombination, have been largely unrealized. These conventional tabular grains either contain no high iodide silver halide phase or have limited its extent to the edges or corners of the tabular grains.

SUMMARY OF THE INVENTION

In one aspect this invention is directed to a photographic emulsion comprised of a dispersing medium and radiation-sensitive silver halide grains with greater than 50 percent of total grain projected area being accounted for by tabular grains comprised of a tabular host portion containing greater than 50 mole percent chloride, based on silver, and having spaced parallel {100} major faces, a shell containing greater than 50 mole percent chloride, based on silver, and accounting for at least 4 percent of total silver surrounding the host portion and, interposed between the shell and the host portion an internal epitaxial phase containing greater than 90 mole percent iodide, based on silver, accounting for less than 60 percent of total silver, and overlying from 15 to 90 percent of the major faces of the host portion.

The emulsions of the invention offer advantages that have heretofore been unrealized in providing intermediate and high aspect ratio tabular grain emulsions for photographic imaging.

The location of the internal epitaxial phase over at least 15 percent (preferably at least 25 percent) of the major faces of the tabular host portions optimally positions this high iodide phase for absorption of short (400 to 450 nm) blue light. With only thin plates of the high iodide internal epitaxial phase short blue absorptions far exceeding those attainable with adsorbed spectral sensitizing dye are realized. By combining the tabular grains of the invention with spectral sensitizing dye exhibiting blue absorption maxima (hereafter referred to as blue spectral sensitizing dyes) even higher blue speeds can be realized. By employing the tabular grain emulsions of the invention in combination with long (450 to 500 nm) blue absorption maxima spectral sensitizing dyes, increased levels of light capture over the entire blue portion of the spectrum can be realized.

The tabular grain emulsions of the invention are, in fact, so efficient in blue absorption that it is possible to eliminate from a multicolor photographic element underlying blue filter layers customarily incorporated to protect minus blue recording emulsion layers from unwanted blue exposure, while still avoiding objectionable blue contamination of the minus blue recording records.

Whereas, it has been frequently suggested to incorporate iodide in silver iodobromide tabular grain emulsions in concentrations up to iodide saturation, about 40 mole percent iodide, superior blue light absorption can be realized by the emulsions of the invention with lower overall levels of iodide. For example, the high iodide internal epitaxial phase preferably accounts for less than 25 percent of the total silver forming the tabular grain emulsions of the invention.

Yet another advantage of the emulsions of the invention is that sites are distributed over the major faces of the host tabular grain portions for photohole capture and separation from photoelectrons. This reduces the risk of photohole-photoelectron recombination and increases latent image forming efficiency in both the blue and minus blue regions of the spectrum.

The internal location of the high iodide phase allows latent image formation and development initiation at relatively low iodide sites on the surfaces of the tabular grains. Restriction of the internal epitaxial phase to less than all of the major faces of the tabular host portions allows development to proceed uninterrupted from the shell to the tabular host portions of the grains, thereby maintaining higher development rates and achieving better utilization of silver than a high iodide phase alone permits.

Surprisingly, the shell increases speed and contrast and lowers minimum density.

BRIEF DESCRIPTION OF THE DRAWINGS

FIG. 1 is a schematic diagram of a composite tabular grain satisfying the requirements of the invention, except that the shell has been omitted for ease of visualization.

FIG. 2 is a sectional view along section line A—A in FIG. 1, shown with the shell present.

DESCRIPTION OF PREFERRED EMBODIMENTS

Figure 3:
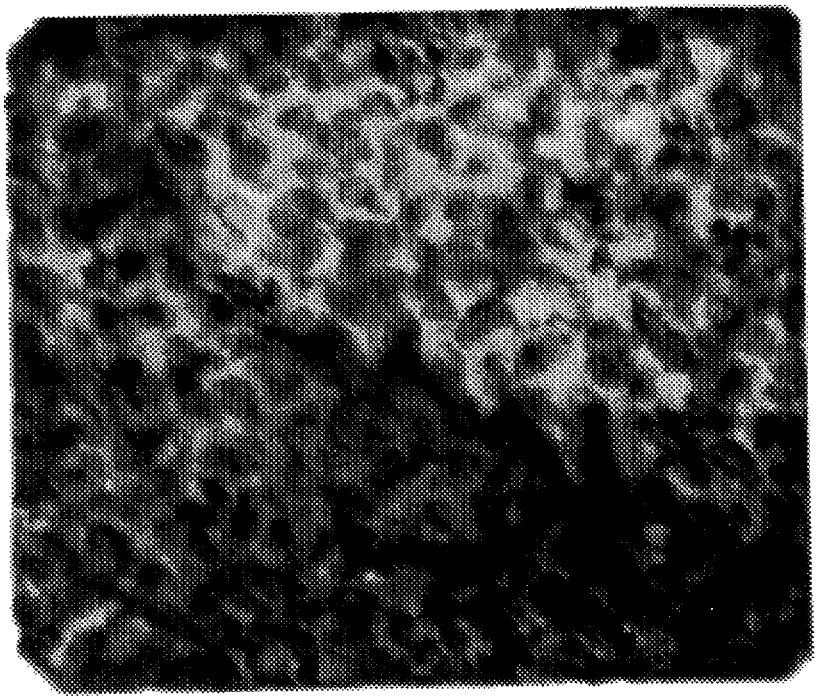
FIG. 3 is a transmission electron micrograph of a representative composite grain according to the invention as it appears before shelling.
Figure 4:
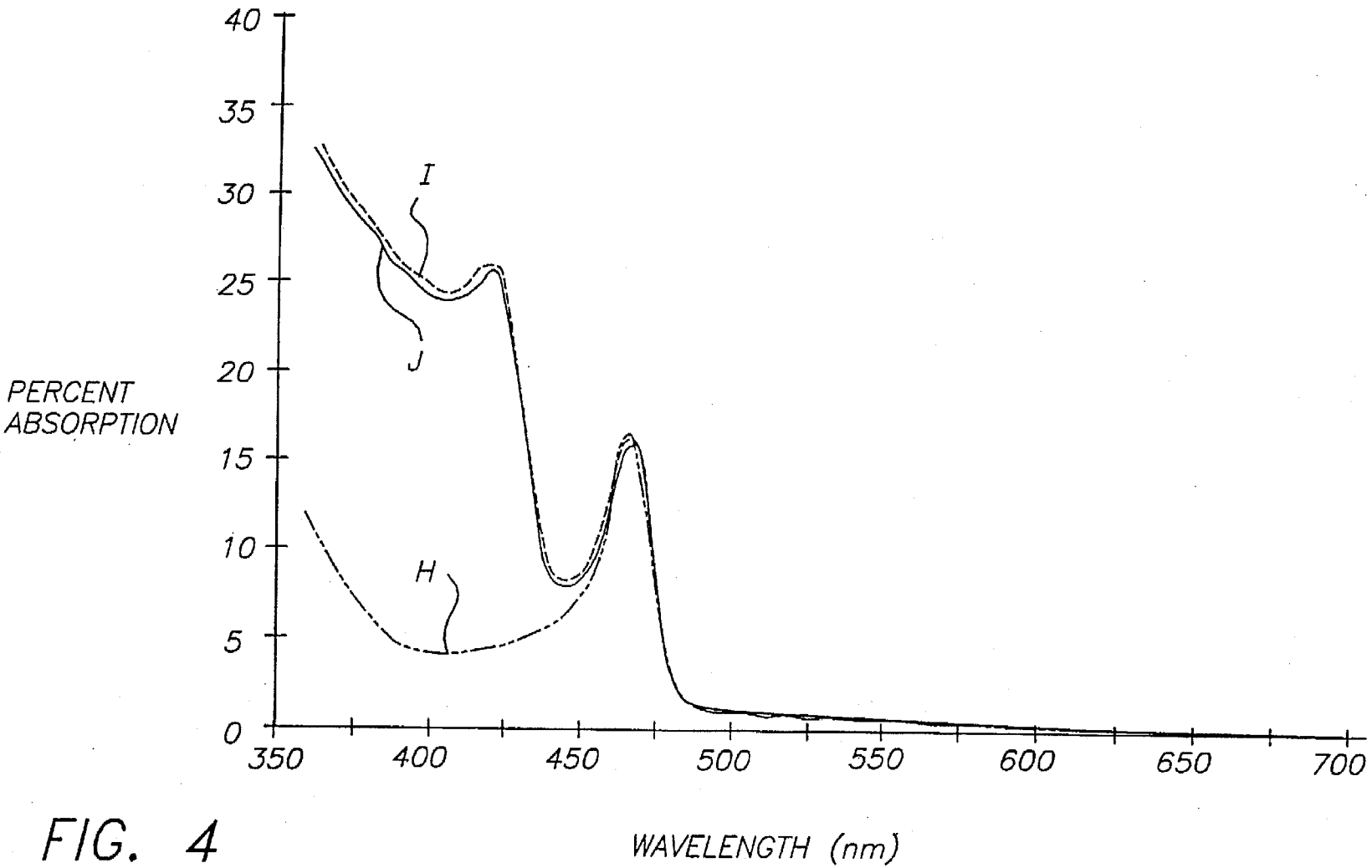
FIG. 4 is a plot of percent absorption versus wavelength in nanometers (nm).

At least 50 percent of the total grain projected area of emulsions according to the invention is accounted for by composite silver halide grains having at least three components: (1) a high chloride {100} tabular host portion, (2) a high chloride shell accounting for at least 4 percent of total silver and (3) interposed between the shell and the tabular host portion, a high iodide internal epitaxial phase partially overlying the major faces of the tabular host portion. The host portion and the shell each exhibit a face centered cubic rock salt (FCCRS) crystal lattice structure while the internal epitaxial phase forms a separate silver halide phase containing greater than 90 mole percent iodide, based on silver. The internal epitaxial phase accounts for less than 60 (preferably less than 25) percent of total silver and occupies from 15 (preferably 25) to 90 percent of the major faces of the tabular host portions.

The composite grain structure can be appreciated by reference to FIGS. 1 and 2. A composite tabular grain structure 100 is shown in FIG. 2 as a section along A—A in FIG. 1. A shell 101 is shown in FIG. 2, but in FIG. 1 the shell is omitted, so that the remaining structure of the composite grain can be more easily appreciated. A tabular host portion 103 is provided by a high chloride {100} tabular grain having major faces 105 and 107. Epitaxially grown on the major faces are discrete plates 109, schematically shown as square domains (see FIG. 3 for an actual grain comparable to schematic FIG. 1). The feature to note is that the domains overlie at least 15 (preferably 25) percent of the major faces, yet are restricted so that the shell lies in contact with at least 10 percent of the major faces.

As is well understood in the art, tabular grains are oriented with their major faces approximately normal to the direction of light transmission during imagewise exposure in a photographic element. When the grain 100 is exposed to light in the short (400 to 450 nm) blue region of the spectrum, photons are initially absorbed preferentially (and in some cases entirely) in the plates 109 on the major faces 105 and 107 of the tabular host portion 103. The plates on both the major face nearer to and farther from the source of exposing short blue light actively absorb short blue photons, since the shell and tabular host portion, each having an FCCRS crystal lattice, cannot absorb more than a small fraction of the exposing short blue light and unabsorbed light is transmitted through the tabular host portion.

Measured along the section line A—A, the plates as shown in FIG. 2 overlie 35% of the upper major face and 48% of the lower major face. Notice that the plates on the upper and lower major faces are not aligned. At some points a short blue photon encounters no plate in passing through the composite grain, in other areas one plate, and in remaining areas two plates. As shown the upper and lower plates are positioned to intercept 71% of photons incident along section line A—A.

It should be noticed that location of the plates on the major faces of the tabular host portion is an ideal orientation for short blue photon absorption. In this orientation the plates present a maximum target area for the photons. If the plates were instead located entirely on the peripheral edge 111 of the tabular host grain portion, they would present a much smaller target area and fewer short blue photons would be absorbed. Although the ideal is to eliminate edge plates, as shown, it is recognized that in practice plates are usually located to some extent on both the edge and major face surfaces of the tabular host portions. However, techniques are described below for minimizing the proportion of the plates located along the peripheral edge.

If, instead of forming a high iodide silver halide phase on the surface of the tabular host portion, the tabular host portion is simply optimally sensitized with a spectral sensitizing dye having a short blue absorption maxima (hereinafter referred to as a short blue spectral sensitizing dye), the highest blue light absorption attainable without desensitization is still much less than that which can be obtained by employing the internal epitaxial phase as described. Maximum light absorption by an optimally spectrally sensitized tabular grain is typically in the 10 to 15 percent range. By contrast, the high iodide epitaxial phase can produce short blue light absorptions in each grain that are well in excess of 50 percent. Since in emulsion coatings the path of exposing radiation intercepts a plurality of grains, it is appreciated that capture of short blue photons can approach 100 percent when the emulsions of the invention are employed. Nevertheless, to reduce the amount of silver required in coating, it is specifically contemplated, as one alternative, to employ an emulsion according to the invention in combination with one or more conventional short blue spectral sensitizing dyes.

When a blue spectral sensitizing dye (a dye having an absorption maximum in the 400–500 nm spectral region) is selected for a conventional tabular grain emulsion, a theoretically ideal choice is a dye having a half-peak bandwidth (a spectral wavelength range over which it exhibits an absorption of at least half its maximum absorption) of 100 nm, extending from 400 to 500 nm. In practice, few spectral sensitizing dyes exhibit 100 nm half peak bandwidths, nor are actual half peak bandwidths coextensive with the blue region of the spectrum. Typical blue spectral sensitizing dyes exhibit half peak bandwidths of less than 50 nm.

In a specifically preferred form of the invention it is contemplated to employ emulsions according to the invention in combination with one or more spectral sensitizing dyes having an absorption maxima in the long blue (450–500 nm) region of the spectrum (hereinafter referred to as a long blue spectral sensitizing dye). The high iodide silver halide provided by the internal epitaxial phase offers peak absorption near 425 nm. When this absorption is combined with that provided by a long blue spectral sensitizing dye, a higher blue absorption over the entire blue portion of the spectrum is realized.

It is, of course, possible to employ combinations of short and long blue spectral sensitizing dyes with the tabular grain emulsions of the invention. Assuming dyes are selected of equal efficiencies, when this is undertaken, the proportion of total sensitivity provided by the combination of blue spectral sensitizing dyes is no higher and usually somewhat less than that which can be obtained by employing the long blue spectral sensitizing dye alone.

When, in the absence of a spectral sensitizing dye, a short blue photon is absorbed by a plate, a photohole and a photoelectron pair are created. The photoelectron is free to migrate across the epitaxial junction into the tabular host portion. On the other hand, the photohole is trapped within the plate. What therefore occurs is separation of the photoelectron from the photohole, which in turn minimizes the risk of their mutual annihilation by recombination. Thus, the plates contribute to larger numbers of photoelectrons being available for latent image formation and enhance the overall sensitivity of the emulsion grains.

When a spectral sensitizing dye of any absorption maxima is employed in combination with the composite grains of the invention, a full range of conventional choices of spectral sensitizing dyes are available, since the high iodide plates are separated from the surface of the composite grains by the shell. If the high iodide plates were located at the surface of the composite grains, it would be necessary for the spectral sensitizing dye to exhibit a reduction potential more positive than −1.30 volts for electron injection to occur. Since spectral sensitizing dyes with reduction potentials in the range of from −1.35 to −1.80 volts are quite common and spectral sensitizing dyes with reduction potentials as negative as −2.0 volts have been identified, it is appreciated that the shell performs an important function by increasing the available choices of dyes capable of efficiently spectrally sensitizing the composite tabular grains.

In the emulsions of the invention both the tabular host portions and the shell contain greater than greater than 50 mole percent chloride, based on silver forming these grain portions. Preferably they contain greater than 70 mole percent chloride and optimally greater than 90 mole percent chloride, based on silver. Silver chloride tabular host portions and shells can be present, either singly or in combination. An important advantage of high chloride compositions in the tabular host portion and the shell is increased development rates.

The emulsions of the invention can be prepared by starting with any conventional high chloride tabular grain emulsion. Since high chloride grains favor {100} crystal faces, the most stable form of high chloride tabular grains are those having {100} major faces (elsewhere also referred to as high chloride {100} tabular grains). Since the edges of the tabular grains account for a very small percentage of their total surface area, they can assume any convenient crystal face orientation. High chloride {100} tabular grains with varied combinations of {111}, {110} and/or {100} edges are well known.

Emulsions containing {100} major face tabular grains are illustrated by the following:

Maskasky U.S. Pat. No. 5,275,930;
Maskasky U.S. Pat. No. 5,292,632;
Brust et al U.S. Pat. No. 5,314,798;
House et al U.S. Pat. No. 5,320,938;
Szajewski U.S. Pat. No. 5,310,635;
Szajewski et al U.S. Pat. No. 5,356,764;
Brust et al U.S. Pat. No. 5,395,746;
Maskasky U.S. Pat. No. 5,399,477;
Chang et al U.S. Pat. No. 5,413,904; and
Budz et al U.S. Pat. No. 5,451,490.

The starting high chloride {100} tabular grain emulsions can have any photographically useful mean ECD, typically up to 10 μm, but preferably the tabular grain emulsions have a mean ECD of 5 μm or less. The starting tabular grains can have any thickness, ranging from the minimum reported thicknesses for ultrathin (<0.07 μm) tabular grain emulsions up to the maximum thickness compatible with a >5 average aspect ratio. It is generally preferred that the starting tabular grains have a thickness of less than 0.3 μm, more preferably, less than 0.2 μm, and, most preferably less than 0.07 μm.

The tabular grains of the starting emulsions (preferably those having a thickness of <0.3 μm, more preferably <0.2 μm, and most preferably <0.07 μm) account for greater than 50 percent, preferably greater than 70 percent and most preferably greater than 90 percent of total grain projected area. In specifically preferred starting tabular grain emulsions substantially all (greater than 97 percent) of total grain projected area can be accounted for by tabular grains.

The starting tabular grain emulsions can exhibit any conventional level of dispersity, but preferably exhibit a low level of dispersity. It is preferred that the starting tabular grain emulsion exhibit a coefficient of variation (COY) of grain diameter of less than 30 percent, most preferably less than 25 percent. Conventional starting tabular grain emulsions are known having a COY of less than 10 percent. Grain COY is herein defined as 100 times the standard deviation of grain ECD divided by mean grain ECD.

The internal epitaxial phase is created by externally depositing a first epitaxial phase on the starting tabular grains (the tabular host portions of the final composite grains). The first epitaxial phase contains at least 90, preferably at least 95, mole percent iodide, based on silver. The remaining halide can be bromide and/or chloride. The inclusion of minor amounts of halides other than iodide is typically the result of undertaking precipitation of the epitaxial phase by silver and iodide ion introduction into the starting tabular grain emulsion in the presence of chloride ions (and in some instances bromide ions) in the dispersing medium of the starting tabular grain emulsion that are in equilibrium with the tabular grains. Bromide and/or chloride ion inclusion can be limited by limiting their availability and is in all instances limited by the inability of the bromide and/or chloride ions to incorporate into the crystal lattice structure of the first epitaxial phase, which is not an FCCRS crystal lattice structure, in concentrations of greater than 10 mole percent.

Silver iodide under conditions relevant to emulsion precipitation is generally reported to form either a hexagonal wurtzite (β phase) or face centered cubic zinc blend type (γ phase) silver iodide phase. Depending upon the specific precipitation conditions selected it is believed that the internal epitaxial phase can be any one or a combination of these phases.

The internal epitaxial phase preferably accounts for less than 25, more preferably less than 20 and, in most instances, less than 10, percent of the total silver forming the composite grains. The minimum amount of silver contained in the first epitaxial phase is determined by the requirement that this phase be located on at least 25 percent of the major faces of the host tabular grains. Fortunately, it has been discovered that the first epitaxial phase can be deposited on the major faces in the form of thin plates, preferably having thicknesses in the range of from 50 nm (0.05 μm) to 1 nm (0.001 μm). Thus, very small amounts of silver in the first epitaxial phase are capable of occupying a large percentage of the major faces of the host tabular grains.

As the thickness of the host tabular grains decreases, it is appreciated that the percentage of total silver provided by the first epitaxial phase increases, even when the thickness of the plates and the percentage of the total surface they occupy remains the unchanged. Thus, with ultrathin (<0.07 mean ECD) host tabular grains, it is contemplated that nearly 60 percent of the total silver forming the composite grains can be provided by first epitaxial phase. However, even using ultrathin host tabular grain emulsions, it is preferred to limit the first epitaxial phase to less than 50 percent of total silver forming the composite grains.

Exactly how thick the plates of the first epitaxial phase should be and what percentage of total major face coverage should be sought for optimum performance depends upon the function that the first epitaxial phase is required to perform. If an emulsion of the invention is intended to be employed primarily for absorbing short blue light on exposure, short blue light absorption increases as the thickness of the plates is increased and as the percentage of the major faces of the host tabular grains occupied is increased. At 427 nm, the absorption maxima of silver iodide, the portion of a silver iodide epitaxial phase on the upper major faces of the host tabular grains is capable of absorbing 63 percent of the photons it receives when the epitaxial phase thickness is 50 nm, and 86 percent of the photons passing through the silver iodide epitaxial phase located on both major faces of the host tabular grains are absorbed. These short blue absorptions are so much higher than those of the silver iodobromides and blue spectral sensitizing dyes conventionally used for short blue absorption, it is apparent that the plates can be much thinner than 50 nm and still offer advantageous short blue light absorption. Further, it must be kept in mind that at conventional silver coating coverages of silver halide emulsions several tabular grains are positioned to intercept a photon received at any one point. To distribute short blue light absorption within the grain population and thereby use the grains to maximum advantage it is preferred to decrease the thickness of the plates to less than 25 nm, most preferably less than 10 nm, while increasing the percentage of the host tabular grain major surfaces they overlie. It is preferred that the plates occupy at least 50, most preferably at least 70, percent of the major faces of the host tabular grains.

It should be specifically noted that the probability of a short blue photon being transmitted through an emulsion layer containing grains according to the invention can be reduced to such a low level that the common problem of blue punch through can be virtually non-existent. Stated another way, short blue light penetrating the emulsion layer can be reduced to such low levels that common protective approaches, such as yellow (blue absorbing) filter layers to protect underlying minus blue recording layers from blue light exposure can be omitted without incurring any significant imaging penalty.

If, instead of short blue absorption, the emulsions of the invention are employed in combination with a minus blue spectral sensitizing dye with the function of the high iodide silver halide epitaxial phase being limited to providing a surface trap for photoholes, then both the thickness and the percentage of major face coverage of the plates can be reduced. Only a minimal thickness is required for a plate to function as a hole trap. At the same time, if the plate is not located to intercept a photon, it can still act as a hole trap, since lateral migration of holes and electrons within the FCCRS crystal lateral structure is more than adequate to allow this to occur. However, for maximum imaging efficiency it is still preferred that the plates occupy at least 25 percent of the major faces of the host tabular grains.

For the composite grains to maintain high levels of imaging efficiency it is essential that the high iodide silver halide epitaxial phase be restricted to only a portion of the host tabular grain exterior surfaces. In the present invention the first epitaxial phase is limited to 90 percent of the major faces of the tabular grains forming the tabular host portions of the composite tabular grains. This avoids the arrest of development that would otherwise occur if the internal epitaxial phase formed a continuous shell.

It is preferred to deposit the high iodide silver halide epitaxy on the host tabular grains by controlled double jet precipitation. For successful high iodide plate formation on the major faces of the host tabular grains it has been discovered that both the iodide and chloride ion concentrations in the dispersing medium surrounding the grains must be controlled during formation of the high iodide first epitaxial phase. To appreciate the parameters involved it is first necessary to recognize that silver halide (AgX, where X represents any photographically useful halide) exists in a photographic emulsion in equilibrium with its component ions. This is illustrated as follows:

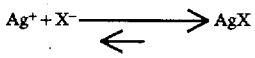

$$Ag^+ + X^- \rightleftharpoons AgX \quad (I)$$

While at equilibrium almost all of the silver and halide ions are present in the AgX crystal structure, a low level of $Ag^+$ and $X^-$ remain in solution. At any given temperature the activity product of $Ag^+$ and $X^-$ is, at equilibrium, a constant and satisfies the relationship:

(II)

$$K_{sp}=[Ag^+][X^-]$$

where $[Ag^+]$ represents the equilibrium silver ion activity, $[X^-]$ represents the equilibrium halide ion activity, and $K_{sp}$ is the solubility product constant of the silver halide.

To avoid working with small fractions, the following relationship is also widely employed:

(III)

$$-\log K_{sp}=pAg+pX$$

where pAg represents the negative logarithm of the equilibrium silver ion activity and pX represents the negative logarithm of the equilibrium halide ion activity.

The solubility product constants of the photographic silver halides are well known. The solubility product constants of AgCl, AgBr and AgI over the temperature range of from 0° to 100° C. are published in Mees and James, *The Theory of the Photographic Process,* 3rd Ed., Macmillan, 1966, at page 6. Specific values are provided in Table I.

TABLE I

| Temperature °C. | AgCl $-\log K_{sp}$ | AgI $-\log K_{sp}$ | AgBr $-\log K_{sp}$ |
|---|---|---|---|
| 40 | 9.2 | 15.2 | 11.6 |
| 50 | 8.9 | 14.6 | 11.2 |
| 60 | 8.6 | 14.1 | 10.8 |
| 70 | 8.3 | — | 10.5 |
| 80 | 8.1 | 13.2 | 10.1 |
| 90 | 7.6 | — | 9.8 |

In preparing photographic emulsions the relative amounts of $Ag^+$ are maintained less than those of $X^-$ to avoid fogging the emulsion. The relationship in which the concentrations of $Ag^+$ and $X^-$ in solution are equal is referred to as the equivalence point. The equivalence point is the pX of the most soluble halide present that is exactly half the $-\log K_{sp}$ of the corresponding silver halide.

To minimize the risk of halide conversion occurring in the host tabular grains during precipitation of the high iodide plates it is contemplated to limit the concentration of iodide ion in the dispersing medium during precipitation to a pI of greater than 4.0. Lower levels of iodide in solution ranging to a pI of 9.5 are contemplated. A preferred pI range of is from about 4.5 to 9.0.

To maximize major face deposition of the high iodide epitaxy and minimize peripheral edge deposition it is preferred that the concentration of the chloride halide ion in solution be maintained between a concentration of minimum solubility and the equivalence point. For example, the equivalence point of silver chloride at 60° C. occurs at a pCl 4.3 and its minimum solubility occurs at a pCl of 2.4. Thus, the concentration of the chloride in solution is preferably maintained between 2.4 and 4.3 at 60° C.

Normally high chloride tabular grain emulsions are precipitated with a large halide ion excess. The halide ion concentration in solution is well above its minimum solubility concentration. Silver chloride tabular grains are typically precipitated at pCl values of less than 2.4. Thus adjustment of the remaining halide ion concentrations in solution, in addition to introducing concurrently iodide and silver ions, is contemplated for deposition of the high iodide epitaxy preferentially onto the major faces of the host tabular grains.

In FIGS. 1 and 2 the high iodide epitaxy is schematically shown as discrete square plates. In fact, the plates usually take varied rectangular forms. Under the conditions that most favor major face deposition, the high iodide epitaxy loses its linear boundaries, with adjacent plates often merging, until the rectangular configuration becomes non-discernible, as shown in FIG. 3.

Following deposition of the first epitaxial phase, corresponding to the internal epitaxial phase of the completed composite tabular grains, the high chloride shell is deposited over the exterior surfaces of the first epitaxial phase and the tabular host portions. As demonstrated in the Examples below the shell must account for at least 4 percent of total silver to realize the advantages of the invention. Preferably the shell accounts for at least 8 percent of total silver forming the composite tabular grains. There is no advantage to be gained by increasing further the thickness of the shell. Shell thicknesses of less than 20 percent of total silver are contemplated in all instances. Preferably the shell accounts for less than 15 percent of total silver.

It should be noticed that the shell overlies not only the high iodide silver halide epitaxy on the major faces of the tabular grains forming the tabular host portions but overlies as well any of the high iodide silver halide epitaxy on the edges of the tabular host portions.

Since both the first epitaxial phase and shell can be quite thin and account for only a small percentage of total silver, it is apparent that the various numerical parameters (e.g., aspect ratio, ECD, COV, and percent of total grain projected area) stated above for the starting tabular grain emulsions can also be satisfied by the composite tabular grains.

It is specifically contemplated to incorporate one or more dopants in the FCCRS crystal lattice structure of the composite tabular grains, either in the tabular host portion or in the shell. When two or more dopants are incorporated, it is specifically contemplated to place one dopant in the tabular host portion and another in the shell to avoid antagonistic effects that can occur when dissimilar dopants are present in the same grain region. Any conventional dopant known to be useful in an FCCRS crystal lattice can be incorporated. Photographically useful dopants selected from a wide range of periods and groups within the Periodic Table of Elements have been reported. Conventional dopants include ions from periods 3 to 7 (most commonly 4 to 6) of the Periodic Table of Elements, such as Fe, Co, Ni, Ru, Rh, Pd, Re, Os, Ir, Pt, Mg, Al, Ca, Sc, Ti, V, Cr, Mn, Cu, Zn, Ga, Ge, As, Se, Sr, Y, Mo, Zr, Nb, Cd, In, Sn, Sb, Ba, La, W, Au, Hg, Tl, Pb, Bi, Ce and U. The dopants can be employed (a) to increase the sensitivity, (b) to reduce high or low intensity reciprocity failure, (c) to increase, decrease or reduce the variation of contrast, (d) to reduce pressure sensitivity, (e) to decrease dye desensitization, (f) to increase stability (including reducing thermal instability), (g) to reduce minimum density, and/or (h) to increase maximum density. For some uses any polyvalent metal ion is effective. The following are illustrative of conventional dopants capable of producing one or more of the effects noted above when incorporated in the silver halide epitaxy: B. H. Carroll, "Iridium Sensitization: A Literature Review", *Photographic Science and Engineering,* Vol. 24, No. 6, November/December 1980, pp. 265–267; Hochstetter U.S. Pat. No. 1,951,933; De Witt U.S. Pat. No. 2,628,167; Spence et al U.S. Pat. No. 3,687,676 and Gilman et al U.S. Pat. No. 3,761,267; Ohkubo et al U.S. Pat. No. 3,890,154; Iwaosa et al U.S. Pat. No. 3,901,711; Yamasue et al U.S. Pat. No. 3,901,713; Habu et al U.S. Pat. No. 4,173,483; Atwell U.S. Pat. No. 4,269,927; Weyde U.S. Pat. No. 4,413,055; Menjo et al U.S. Pat. No. 4,477,561; Habu et al U.S. Pat. No. 4,581,327; Kobuta et al U.S. Pat. No. 4,643,965; Yamashita et al U.S. Pat. No. 4,806,462; Grzeskowiak et al U.S. Pat. No. 4,828,962; Janusonis U.S. Pat. No. 4,835,093; Leubner et al U.S. Pat. No. 4,902,611; Inoue et al U.S. Pat. No. 4,981,780; Kim U.S. Pat. No. 4,997,751; Shiba et al U.S. Pat. No. 5,057,402; Maekawa et al U.S. Pat. No. 5,134,060; Kawai et al U.S. Pat. No. 5,153,110; Johnson et al U.S. Pat. No. 5,164,292; Asami U.S. Pat. Nos. 5,166,044 and 5,204,234; Wu U.S. Pat. No. 5,166,045; Yoshida et al U.S. Pat. No. 5,229,263; Bell U.S. Pat. Nos. 5,252,451 and 5,252,530; Komorita et al EPO 0 244 184; Miyoshi et al EPO 0 488 737 and 0 488 601; Ihama et al EPO 0 368 304; Tashiro EPO 0 405 938; Murakami et al EP0 0 509 674 and 0 563 946 and Japanese Patent Application Hei-2[1990]-249588 and Budz WO 93/02390.

When dopant metals are present during precipitation in the form of coordination complexes, particularly tetra- and hexa-coordination complexes, both the metal ion and the coordination ligands can be occluded within the grains. Coordination ligands, such as halo, aquo, cyano, cyanate, fulminate, thiocyanate, selenocyanate, tellurocyanate, nitrosyl, thionitrosyl, azide, oxo, carbonyl and ethylenediamine tetraacetic acid (EDTA) ligands have been disclosed and, in some instances, observed to modify emulsion properties, as illustrated by Grzeskowiak U.S. Pat. No. 4,847,191, McDugle et al U.S. Pat. Nos. 4,933,272, 4,981,781 and 5,037,732, Marchetti et al U.S. Pat. No. 4,937,180, Keevert et al U.S. Pat. No. 4,945,035, Hayashi U.S. Pat. No. 5,112,732, Murakami et al EPO 0 509 674, Ohya et al EPO 0 513 738, Janusonis WO 91/10166, Beavers WO 92/16876, Pietsch et al German DD 298,320, Olm et al U.S. Pat. No. 5,360,712, and Kuromoto et al U.S. Pat. No. 5,462,849. Olm et al and Kuromoto et al, cited above, disclose hexacoordination complexes containing organic ligands while Bigelow U.S. Pat. No. 4,092,171 discloses organic ligands in Pt and Pd tetra-coordination complexes.

It is specifically contemplated to incorporate in the silver halide epitaxy a dopant to reduce reciprocity failure. Iridium is a preferred dopant for decreasing reciprocity failure. The teachings of Carroll, Iwaosa et al, Habu et al, Grzeskowiak et al, Kim, Maekawa et al, Johnson et al, Asami, Yoshida et al, Bell, Miyoshi et al, Tashiro and Murakami et al EPO 0 509 674, each cited above, are here incorporated by reference.

In another specifically preferred form of the invention it is contemplated to incorporate in the face FCCRS crystal lattice structure of the composite tabular grains a dopant capable of increasing photographic speed by forming shallow electron traps, hereinafter also referred to as a SET dopant. The selection criteria for SET dopants is disclosed in *Research Disclosure,* Vol. 367, November 1994, Item 36736.

In a specific, preferred form it is contemplated to employ as a dopant a hexacoordination complex satisfying the formula:

(IV)

$$[ML_6]^n$$

where

M is filled frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$ or $Pt^{+4}$;

$L_6$ represents six coordination complex ligands which can be independently selected, provided that least four of the ligands are anionic ligands and at least one (preferably at least 3 and optimally at least 4) of the ligands is more electronegative than any halide ligand; and n is −2, −3 or −4.

The following are specific illustrations of dopants capable of providing shallow electron traps:

SET-1 $[Fe(CN)_6]^{-4}$
SET-2 $[Ru(CN)_6]^{-4}$
SET-3 $[Os(CN)_6]^{-4}$
SET-4 $[Rh(CN)_6]^{-3}$
SET-5 $[Ir(CN)_6]^{-3}$
SET-6 $[Fe(pyrazine)(CN)_5]^{-4}$
SET-7 $[RuCl(CN)_5]^{-4}$
SET-8 $[OsBr(CN)_5]^{-4}$
SET-10 $[IrBr(CN)_5]^{-3}$
SET-11 $[FeCO(CN)_5]^{-3}$
SET-12 $[RuF_2(CN)_4]^{-4}$
SET-13 $[OsCl_2(CN)_4]^{-4}$
SET-14 $[RhI_2(CN)_4]^{-3}$
SET-15 $[IrBr_2(CN)_4]^{-3}$
SET-16 $[Ru(CN)_5(OCN)]^{-4}$
SET-17 $[Ru(CN)_5(N_3)]^{-4}$
SET-18 $[Os(CN)_5(SCN)]^{-4}$
SET-19 $[Rh(CN)_5(SeCN)]^{-3}$
SET-20 $[Ir(CN)_5(HOH)]^{-2}$
SET-21 $[Fe(CN)_3Cl_3]^{-3}$
SET-22 $[Ru(CO)_2(CN)_4]^{-1}$
SET-23 $[Os(CN)Cl_5]^{-4}$
SET-24 $[Co(CN)_6]^{-3}$
SET-25 $[IrCl_4(oxalate)]^{-4}$
SET-26 $[In(NCS)_6]^{-3}$
SET-27 $[Ga(NCS)_6]^{-3}$ It is additionally contemplated to employ oligomeric coordination complexes to increase speed, as taught by Evans et al U.S. Pat. No. 5,024,931, the disclosure of which is here incorporated by reference.

The SET dopants are effective in conventional concentrations, where concentrations are based on the total silver in both the silver in the tabular grains and the silver in the second epitaxial phase. Generally shallow electron trap forming dopants are contemplated to be incorporated in concentrations of at least $1\times10^{-7}$ mole per silver mole up to their solubility limit, typically up to about $5\times10^{-4}$ mole per silver mole. Preferred concentrations are in the range of from about $10^{-5}$ to $10^{-4}$ mole per silver mole.

The contrast of the photographic emulsions of the invention can be further increased by doping FCCRS crystal lattice portions of composite tabular grains with a hexacoordination complex containing a nitrosyl or thionitrosyl ligand. Preferred coordination complexes of this type are represented by the formula:

(v)

$$[TE_4(NZ)E']^r$$

where

T is a transition metal;

E is a bridging ligand;

E' is E or NZ;

r is zero, −1, −2 or −3; and

Z is oxygen or sulfur.

The E ligands are typically halide, but can take any of the forms found in the SET dopants discussed above. A listing of suitable coordination complexes satisfying formula V is found in McDugle et al U.S. Pat. No. 4,933,272, the disclosure of which is here incorporated by reference.

The contrast increasing dopants (hereinafter also referred to as NZ dopants) can be incorporated in the composite tabular grain structure at any convenient location. However, if the NZ dopant is present at the surface of the grain, it can reduce the sensitivity of the grains. It is therefore preferred that the NZ dopants be located in the tabular host portions so that they are separated from the grain surface. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole, based on silver in the host grains. It is also possible to locate an NZ dopant in the second epitaxial phase, but this is not a preferred location for this dopant.

A significant advantage of the composite tabular grain structure is that all conventional sensitizations for high chloride FCCRS crystal lattice structures are fully applicable to the composite tabular grain emulsions of the invention. Conventional chemical sensitizations are summarized in *Research Disclosure,* Vol. 365, September 1994, Item 36544, IV. Chemical sensitization. The shell structure insures that all of the exterior surface of the grains is available for sensitization and that difficulties in the sensitization of high iodide silver halides at their surface are avoided. Reduction sensitizers, middle chalcogen (e.g., sulfur) sensitizers, and noble metal (e.g., gold) sensitizers, employed singly or in combination are specifically contemplated.

The emulsions of the invention can be reduction sensitized in any convenient conventional manner. Conventional reduction sensitizations are summarized in *Research Disclosure,* Item 36544, cited above, IV. Chemical sensitization, paragraph (1). A specifically preferred class of reduction sensitizers are the 2-[N-(2-alkynyl)amino]-meta-chalcazoles disclosed by Lok et al U.S. Pat. Nos. 4,378,426 and 4,451,557, the disclosures of which are here incorporated by reference.

Preferred 2-[N-(2-alkynyl)amino]-meta-chalcazoles can be represented by the formula:

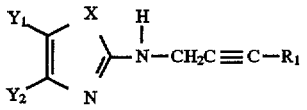

(VI)

where

X=O, S, Se;

$R_1$=(VIa) hydrogen or (VIb) alkyl or substituted alkyl or aryl or substituted aryl; and $Y_1$ and $Y_2$ individually represent hydrogen, alkyl groups or an aromatic nucleus or together represent the atoms necessary to complete an aromatic or alicyclic ring containing atoms selected from among carbon, oxygen, selenium, and nitrogen atoms.

As disclosed by Eikenberry et al, cited above, the formula (VI) compounds are generally effective (with the (VIb) form giving very large speed gains and exceptional latent image stability) when present during the heating step (finish) that results in chemical sensitization.

In a preferred form of the invention, an alkynylamino substituent is attached to a benzoxazole, benzothiazole or benzoselenazole nucleus. In one specific preferred form, the compounds VIa of the present invention and companion non-invention compounds VIb can be represented by the following formula:

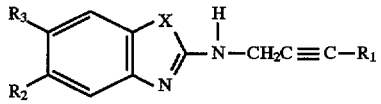

(VII)

where

VIIa–$R_1$=H

VIIa1–$R_1$=H, $R_2$=H, X=O

VIIa2–$R_1$=H, $R_2$=Me, X=O

VIIa3–$R_1$=H, $R_2$=H, X=S

VIIb–$R_1$=alkyl or aryl

VIIbl–$R_1$=Me, $R_2$=H, X=O $R_3$=H

VIIb2–$R_1$=Me, $R_2$=Me, X=O $R_3$=H

VIIb3–$R_1$=Me, $R_2$=H, X=S $R_3$=H

VIIb4–$R_1$=Ph, $R_2$=H, X=O $R_3$=H

Other preferred VIb structures have $R_1$ as ethyl, propyl, p-methoxyphenyl, p-tolyl, or p-chlorophenyl with $R_2$ or $R_3$ as halogen, methoxy, alkyl or aryl.

Whereas previous work employing compounds with structure similar to VIa and VIb described speed gains of about 40% using 0.10 mmole/silver mole when added after sensitization and prior to forming the layer containing the emulsion (Lok et al U.S. Pat. No. 4,451,557), speed gains have been demonstrated by Eikenberry et al ranging from 66% to over 250%, depending on the emulsion and sensitizing dye utilized, by adding 0.02–0.03 mmole/silver mole of Vb during the sensitization step. Significantly higher levels of fog are observed when the VIa compounds are employed.

The VIb compounds of the present invention typically contains an $R_1$ that is an alkyl or aryl. It is preferred that the $R_1$ be either a methyl or a phenyl ring for the best increase in speed and latent image keeping.

The compounds of the invention are added to the silver halide emulsion at a point subsequent to precipitation to be present during the finish step of the chemical sensitization process. A preferred concentration range for [N-(2-alkynyl) -amino]-meta-chalcazole incorporation in the emulsion is in the range of from 0.002 to 0.2 (most preferably 0.005 to 0.1) mmole per mole of silver. In a specifically preferred form of the invention [N-(2-alkynyl)amino]-meta-chalcazole reduction sensitization is combined with conventional gold (or platinum metal) and/or middle (S, Se or Te) chalcogen sensitizations. These sensitizations are summarized in *Research Disclosure* Item 36544, previously cited, IV. Chemical sensitization. The combination of sulfur, gold and [N-(2-alkynyl)-amino]-meta-chalcazole reduction sensitization is specifically preferred.

A specifically preferred class of middle chalcogen sensitizers are tetrasubstituted middle chalcogen ureas of the type disclosed by Herz et al U.S. Pat. Nos. 4,749,646 and 4,810,626, the disclosures of which are here incorporated by reference. Preferred compounds include those represented by the formula:

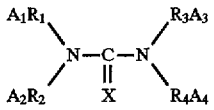

(VIII)

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetrasubstituted thiourea sensitizer is 1,3-dicarboxymethyl-1,3-dimethylthiourea.

Specifically preferred gold sensitizers are the gold (I) compounds disclosed by Deaton U.S. Pat. No. 5,049,485, the disclosure of which is here incorporated by reference. These compounds include those represented by the formula: (IX)

$$AuL_2^+X^- \text{ or } AuL(L^1)^+X^-$$

wherein

L is a mesoionic compound;

X is an anion; and $L^1$ is a Lewis acid donor.

As previously disclosed, in preferred photographic applications the tabular grain emulsions of the invention are spectrally sensitized. One of the significant advantages of the invention is that the presence of a high iodide first epitaxial phase on the major faces of the tabular grains can improve the adsorption of the spectral sensitizing dye or dyes employed and, particularly when the oxidation potential of the dye is more negative than the threshold value stated above, increase the efficiency with which photon energy is transferred between the spectral sensitizing dye and the grains.

Any conventional spectral sensitizing dye or dye combination can be employed with the emulsions of the invention. Suitable spectral sensitizing dye selections are disclosed in *Research Disclosure,* Item 36544, cited above, Section V. Spectral sensitization and desensitization. Preferred spectral sensitizing dyes are polymethine dyes, including cyanine, merocyanine, complex cyanine and merocyanine (i.e., tri-, tetra- and polynuclear cyanine and merocyanine), oxonol, hemioxonol, styryl, merostyryl, streptocyanine, hemicyanine and arylidene dyes. Specifically preferred blue sensitizing dyes are those disclosed by Kofron et al U.S. Pat. No. 4,439,520. The supersensitizing dye combinations set out in *Research Disclosure* Item 36544, Section V, A. Sensitizing dyes, paragraphs (6) and (6a) are specifically contemplated.

In addition to the features specifically described, it is recognized that the emulsions can contain any convenient conventional selection of additional features. For example, the features of the emulsions, such as vehicle (including peptizers and binders), hardeners, antifoggants and stabilizers, blended grain populations, coating physical property modifying addenda (coating aids, plasticizers, lubricants, antistats, matting agents, etc.), and dye image formers and modifiers can take any of the forms described in *Research Disclosure,* Item 36544, cited above. Selections of these other emulsion features are preferably undertaken as taught in the patents cited above to describe the starting tabular grain emulsions.

EXAMPLES

The invention can be better appreciated by reference to the following specific examples. The term "oxidized gelatin" is employed to indicate gelatin that has been treated with hydrogen peroxide to reduce its methionine content below detectable levels. pH was lowered by using nitric acid and increased by using sodium hydroxide.

Host High Chloride {100} Tabular Grain Emulsion

A host silver iodochloride {100} tabular grain emulsion (hereinafter also referred to as Host) was prepared by charging a reaction vessel with 1950 g of regular oxidized gelatin, 30 g of sodium chloride, 17.8 g of Emerest 2648™, a dioleate ester of polyethylene glycol (mol. wt. 400), and 45.5 L of distilled water. The contents of the reaction vessel were raised to a temperature of 35° C. Nucleation occurred during a 1.28 minute period during which 4.0 moles per liter of silver nitrate containing 0.345 g of mercuric chloride (Ag-1) and 4.0 moles per liter of sodium chloride (Cl-1) were introduced at a rate of 1100 mL/min and 1478 mL/min, respectively. The pCl within the reaction vessel was 2.0327. Additional water in the amount of 107 liters, sodium chloride (22.26 g) and potassium iodide (6.54 g) were then introduced into the reaction vessel.

Subsequently the pCl was brought to 2.3961. A first growth segment (I) then occurred over a period of 18 minutes during which the temperature was raised to 50° C. and Ag-1 and Cl-1 were concurrently added by double-jet addition at 129.5 and 173.9 mL/min, respectively.

A second growth segment (II) took place over 20 minutes by continuing precipitation as described for growth segment I, except that the temperature was raised to 70° C., the pCl was lowered to 1.7914, and Ag-1 was ramped linearly to 194.3 mL/min while Cl-1 was parabolically ramped from 260.9 to 173.9 mL/min.

After a 15 minute hold, a third growth segment (III) was undertaken for 38 minutes in which Ag-1 was linearly ramped from 129.5 to 388.4 mL/min and the flow rate of Cl-1 was controlled to maintain a pCl of 1.828. An additional 15 minute ripening period ensued, followed by a pCl adjustment to 1.3496. The emulsion was then cooled to 40° C. and adjusted to a pCl of 2.2622 during ultrafiltration. The pH of the emulsion was adjusted to 5.67.

The resulting high chloride {100} tabular grain emulsion contained 0.05 mole percent overall iodide, based on total silver. The ECD of the emulsion grains was 2.59 μm, and the average thickness of the tabular grains was 0.143 μm. The average aspect ratio of the tabular grains was 18.

Restricted High Iodide Epitaxy on Host

An emulsion (hereinafter referred to as Host+AgI) was prepared by the following procedure:

A 4 L reaction vessel was charged with one mole of the Host emulsion and allowed to equilibrate at 40° C. for 5 minutes and then brought to a temperature of 65° C. The pCl of the emulsion was then raised from 1.5693 to 2.1 during the first few minutes of a 15 minute segment in which concurrent double-jet addition of 0.25N silver nitrate (Ag-2) at flow rates ramped from 2.3 to 11.6 mL/min and 0.3M potassium iodide (I-1) at flow rates ramped from 3.3 to 16.5 mL/min.

A second growth segment followed lasting 15 minutes in which the rate of addition A-2 was ramped from its final flow rate above to a value of 23.1 mL/min and the rate of addition of I-1 was ramped from its final flow rate above to a value of 33 mL/min.

The emulsion was twice washed and brought to a pH of 5.6. The final bulk iodide content of the emulsion 8.28 mole percent, based on total silver. A typical grain is shown in FIG. 3.

Shelling

A 1 L reaction vessel was charged with 0.5 mole of Host or Host+AgI emulsion and held at 40° C. A concurrent double-jet addition of 0.5N silver nitrate (Ag-3) and 0.5N sodium chloride (Cl-3) was then carried out at a pCl of 2.1 for a time sufficient to create each of the following AgCl precipitations:

+0.5AgCl: 0.5 mole percent silver chloride, based on total silver, additionally precipitated.

+0.99AGCl: 0.99 mole percent silver chloride, based on total silver, additionally precipitated.

+4.76AGCl: 4.76 mole percent silver chloride, based on total silver, additionally precipitated.

Evaluations

Each emulsion described above was evaluated in the following manner:

One mole of emulsion was melted at 40° C. Then, in sequence, the following reagents in millimoles per silver mole were added with 5 minute holds between each successive addition: 1.54 mmoles of sodium thiocyanate, 0.65 mmole of the spectral sensitizing dye anhydro-5,5'-dichloro-3,3'-bis(3-sulfopropyl)thiacyanine hydroxide, triethylammonium salt, 0.011 mmole of N,N'-dicarboxymethyl-N,N'-dimethylthiourea, 0.0022 mmole of Au(I)bis (trimethylthiotriazole), and 2.5 mg/Ag mole 3-methyl-1,3-benzothiazolium iodide. Chemical sensitization was effected by raising the emulsion melt containing addenda to 50° C. and holding for 7.5 minutes. Subsequently, the melt was cooled to 40° C. in preparation for coating.

Single emulsion layer coatings were formulated containing 10.76 mg/dm$^2$ silver halide, 16.14 mg/dm$^2$ of gelatin, and 9.684 mg/dm$^2$ of the yellow dye-forming coupler YC-1. The emulsion layer also contained 1.75 g/silver mole of 4-hydroxy-6-methyl-1,3,3a,7-tetraazaindene. The emulsion layer was coated on a transparent film support and overcoated with 10.76 mg/dm$^2$ gelatin and hardened with 1.5% by weight, based on total gelatin weight in both layers, of bis(vinylsulfonyl)methane.

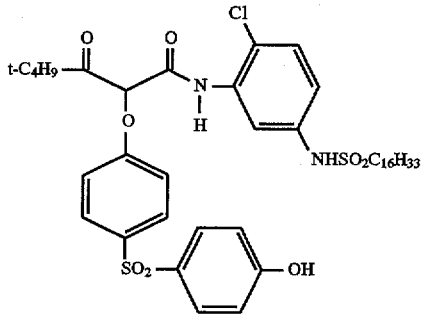

Samples of the coatings were examined for light absorption. The correlation between the absorption curves in FIG. 6 and the samples is shown in Table II.

TABLE II

| Emulsion | Curve |
|---|---|
| Host | H |
| Host + AgI | I |
| Host + AgI + 4.76 AgCl | J |

The samples not included in Table II fell between curves I and J in FIG. 6. In FIG. 6 the absorption peak at 465–470 nm was attributable to the spectral sensitizing dye. By comparing the 465–470 nm absorption peaks it is apparent that the silver iodide epitaxy and shell had only a minor influence on dye absorption. However, the presence of the silver iodide epitaxy markedly increased absorption at wavelengths below 440 nm and the further addition of a shell diminished this absorption only slightly. Clearly the emulsions with high iodide epitaxy showed superior short blue and near ultraviolet absorptions.

Additional samples of the coatings were exposed through a 0–4 density step tablet for 1/50" using a Wratten 2B™ filter (to eliminate <390 nm wavelengths) with a 0.6 neutral density inconel filter and a 3000° K color temperature (tungsten balance) light source. The exposed coatings were developed for 3.25 minutes using the Kodak ECN-2 process, described in Kodak H-24 Manual, *Manual for Processing Eastman Motion Picture Films.*

The sensitometric results are summarized in Table III.

TABLE III

| Emulsion | Dmin | Gamma | Speed* |
|---|---|---|---|
| Host | 0.12 | 3.02 | 193 |
| Host + 0.5 AgCl | 0.1 | 3.02 | 193 |
| Host + 0.99 AgCl | 0.14 | 3.0 | 186 |
| Host + 4.76 AgCl | 0.13 | 2.72 | 183 |
| Host + AgI | 0.34 | 1.0 | 186 |
| Host + AgI + 0.5 AgCl | 0.26 | 1.13 | 178 |
| Host + AgI + 0.99 AgCl | 0.26 | 1.25 | 178 |
| Host + AgI + 4.76 AgCl | 0.21 | 1.3 | 194 |

*inertial speed

From Table III it is apparent that the addition of a silver chloride to the host grains without silver iodide epitaxy had no beneficial effect. The addition of silver iodide epitaxy alone improved short blue and near ultraviolet absorption, but had the disadvantage of raising minimum density, reducing contrast (γ) and decreasing speed. The addition of silver chloride overlying the silver iodide epitaxy dramatically reduced minimum density and increased contrast. However, only when sufficient silver chloride was deposited to create a complete shell (at least 4 percent of total silver) was it possible to recapture the overall speed loss attributable to the addition of the silver iodide epitaxy to the high chloride {100} tabular host grains.

The invention has been described in detail with particular reference to preferred embodiments thereof, but it will be understood that variations and modifications can be effected within the spirit and scope of the invention.

What is claimed is:

1. A photographic emulsion comprised of a dispersing medium and radiation-sensitive silver halide grains with greater than 50 percent of total grain projected area being accounted for by tabular grains comprised of a tabular host portion containing greater than 50 mole percent chloride, based on silver, and having spaced parallel {100} major faces, a shell containing greater than 50 mole percent chloride, based on silver, and accounting for at least 4 percent of total silver surrounding the host portion and, interposed between the shell and the host portion an internal epitaxial phase containing greater than 90 mole percent iodide, based on silver, accounting for less than 60 percent of total silver, and overlying from 15 to 90 percent of the major faces of the host portion.

2. A photographic emulsion according to claim 1 wherein the internal epitaxial phase overlies at least 25 percent of the major faces.

3. A photographic emulsion according to claim 1 wherein the internal epitaxial phase accounts for less than 25 percent of total silver forming the tabular grains.

4. A photographic emulsion according to claim 3 wherein the internal epitaxial phase accounts for less than 10 percent of total silver forming the tabular grain.

5. A photographic emulsion according to claim 1 wherein the tabular host portions contain greater than 70 mole percent chloride, based on silver.

6. A photographic emulsion according to claim 5 wherein the tabular host portions contain greater than 90 mole percent chloride, based on silver.

7. A photographic emulsion according to claim 1 wherein the shell contains up to 20 percent of total silver.

8. A photographic emulsion according to claim 1 wherein the shell contains from 8 to 15 percent of total silver.

9. A photographic emulsion according to claim 1 wherein the shell contains greater than 70 mole percent chloride, based on silver.

10. A photographic emulsion according to claim 9 wherein the shell contains greater than 90 mole percent chloride, based on silver.

* * * * *